United States Patent [19]

Koppelman

[11] 4,129,420

[45] * Dec. 12, 1978

[54] PROCESS FOR MAKING COKE FROM CELLULOSIC MATERIALS AND FUELS PRODUCED THEREFROM

[76] Inventor: Edward Koppelman, 4424 Bergamo Dr., Encino, Calif. 91316

[ * ] Notice: The portion of the term of this patent subsequent to Oct. 4, 1994, has been disclaimed.

[21] Appl. No.: 831,343

[22] Filed: Sep. 7, 1977

Related U.S. Application Data

[63] Continuation-in-part of Ser. No. 648,170, Jan. 12, 1976, Pat. No. 4,052,168.

[51] Int. Cl.[2] ..... C10L 1/32; C10L 9/08; C10B 51/00

[52] U.S. Cl. ..... 44/51; 44/1 F; 44/33; 201/25

[58] Field of Search ..... 44/1 F, 33, 51; 201/21, 201/24, 25

[56] References Cited

U.S. PATENT DOCUMENTS

| | | | |
|---|---|---|---|
| 1,383,888 | 7/1921 | Wells | 201/25 |
| 3,241,505 | 3/1966 | Long et al. | 44/51 X |
| 4,052,168 | 10/1977 | Koppelman | 44/1 G |

*Primary Examiner*—Carl Dees

*Attorney, Agent, or Firm*—Harness, Dickey & Pierce

[57] ABSTRACT

A process for converting cellulosic materials, including waste cellulosic materials, into a useful, low-sulfur and low-ash fuel by subjecting the cellulosic feed material to an autoclaving treatment at a controlled elevated temperature and controlled high pressure for a period of time to convert the moisture and a portion of the organic constituents therein to a gaseous phase and to effect a controlled thermal restructing of the chemical structure thereof, producing a solid carbonaceous or coke-like product and a by-product fuel gas. It is further contemplated that the low-sulfur coke product can be comminuted to a desired particle size range and admixed with high-sulfur fuel oils, providing a blended liquid slurry fuel of an acceptable sulfur content.

12 Claims, 1 Drawing Figure

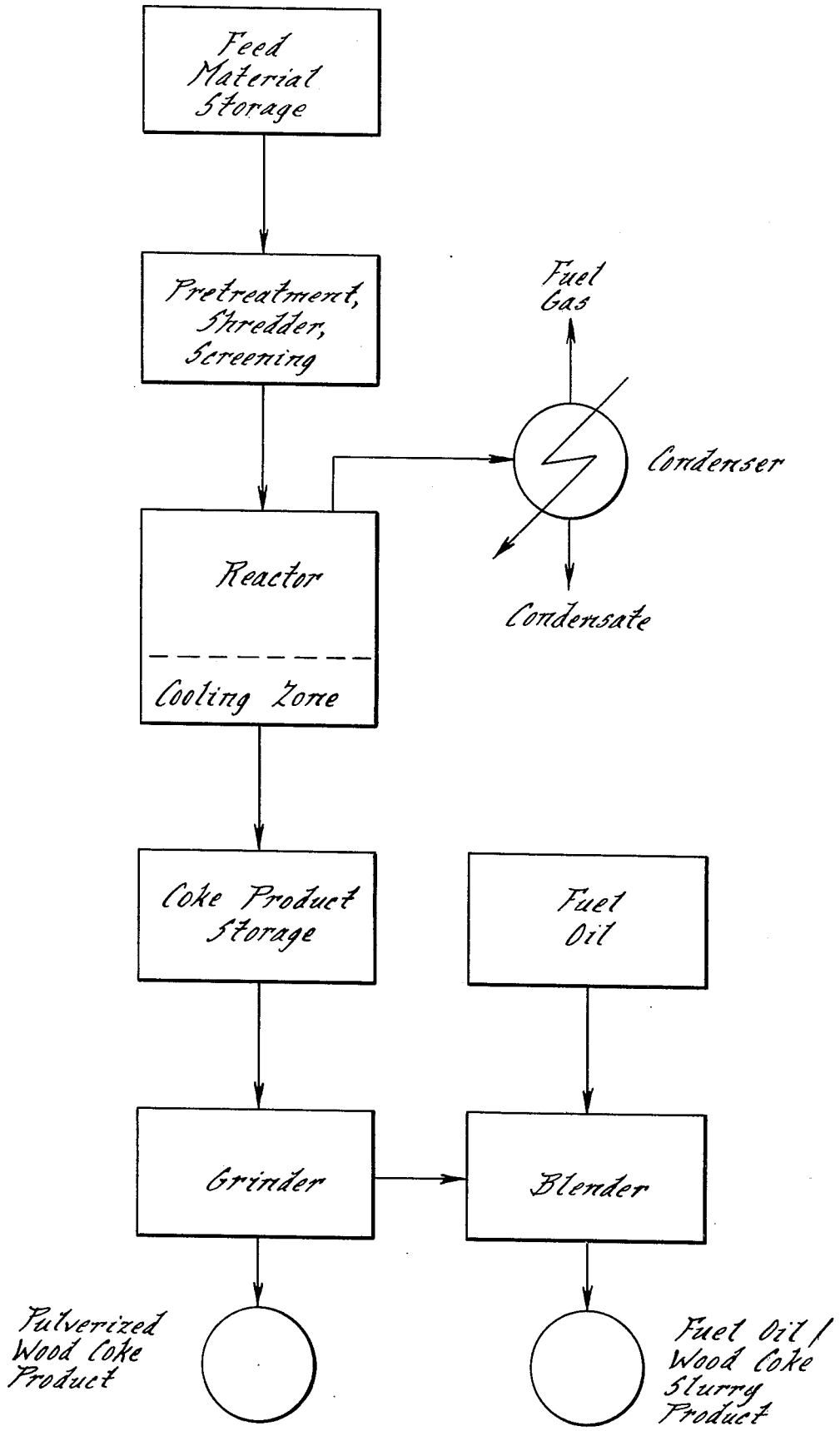
Feed Material Storage
Pretreatment, Shredder, Screening
Fuel Gas
Condenser
Condensate
Reactor
Cooling Zone
Coke Product Storage
Fuel Oil
Grinder
Blender
Pulverized Wood Coke Product
Fuel Oil / Wood Coke Slurry Product

PROCESS FOR MAKING COKE FROM CELLULOSIC MATERIALS AND FUELS PRODUCED THEREFROM

REFERENCED TO RELATED APPLICATIONS

The present application is a continuation-in-part of U.S. application Ser. No. 648,170, filed Jan. 12, 1976, now U.S. Pat. No. 4,052,168, granted Oct. 4, 1977, for "Process for Upgrading Lignitic-Type Coal As A Fuel".

BACKGROUND OF THE INVENTION

In the aforementioned parent application Ser. No. 648,170, a process is disclosed for upgrading lignitic-type coals including brown coal, lignite and subbituminous coals, to render them more suitable as a solid fuel as a result of the thermal restructuring thereof, producing an upgraded carbonaceous product which is stable, resistant to weathering and of increased heating value, approaching that of bituminous coal. As a result of such process, the vast domestic deposits of lignitic-type coal are converted into a useful fuel and provide a potential solution to the present energy crisis.

In addition to the large domestic deposits of lignitic-type coals, vast quantities of cellulosic type materials, both naturally occurring, such as peat, as well as waste materials derived from lumbering operations and agricultural wastes, are generated each year, which are available in a form unsuitable for efficient use as a commercial fuel. Such waste cellulosic materials such as sawdust, bark, wood scrap, branches and chips from lumbering operations, as well as various agricultural waste materials such as cotton plant stalks and the like, have heretofore represented a waste disposal problem. There has, accordingly, been a long felt need for a process for converting such cellulosic materials into valuable fuel products, thereby not only providing a potential solution to the fuel shortage and present energy crisis, but also eliminating the expense in disposing of such waste materials.

In addition to the foregoing problems, Federal and state regulations, such as enacted by the Environmental Protection Agency, as well as by the state of California, have imposed relatively stringent limitations on the quantity of sulfur in heating oils that can be burned by public utilities for generation of electricity and steam power. Current EPA regulations permit a maximum sulfur content per pound of heating oil of about 0.7%, whereas the state of California has imposed regulations limiting the sulfur content to a maximum level of 0.3% sulfur in certain areas. In order to comply with these regulations, it has heretofore been necessary to blend off domestic heating oils of relatively high sulfur content with low-sulfur heating oils imported from overseas in order to provide a residual blend having a sulfur content within the permissible limits. The premium cost of such foreign low-sulfur heating fuels makes this practice not only costly, but also increases our reliance on foreign oil sources. The foregoing problem is overcome in accordance with the present invention by providing an extremely low sulfur and low ash coke-like product which upon comminution can be admixed with high sulfur heating oils, providing a residual liquid slurry blend which meets regulatory requirements with respect to sulfur content.

SUMMARY OF THE INVENTION

The benefits and advantages of the present invention are achieved by a process whereby various cellulosic materials such as peat, forest and agricultural wastes and the like, are employed as a feed material and are charged into an autoclave in which they are heated to an elevated temperature of at least about 750° F. and a pressure of at least about 1000 psi for a controlled period of time to effect a conversion of the moisture and a portion of the organic constituents therein into a gaseous phase and a thermal restructuring of the feed material into a carbonaceous coke-like product. The gaseous phase formed during the autoclaving operation is withdrawn and the noncondensible portion thereof provides a fuel gas which can be recovered for use in the process. The solid coke product produced is cooled at the conclusion of the autoclaving step to a temperature at which it can be exposed to the atmosphere without combustion and can be further comminuted as may be desired to provide for a particulated fuel.

In accordance with a further embodiment of the present invention, the coke product produced in the autoclave is comminuted to a particle size of less than about 48 mesh, and preferably to a particle size less than about 200 mesh, whereafter it is admixed with a high-sulfur heating fuel in an amount ranging from as low as about 1% up to about as high as 50% by weight of the total mixture, producing a liquid slurry. The characteristics of the particulated coke enable the formation of stable suspensions without the addition of any chemical suspension agents and the low sulfur content of a magnitude of about only 0.1% and an ash content of only about 1% to about 4% provides for a satisfactory fuel blend.

Additional benefits and advantages of the present invention will become apparent upon a reading of the description of the preferred embodiments taken in conjunction with the drawing and examples provided.

BRIEF DESCRIPTION OF THE DRAWING

The drawing comprises a schematic flow diagram of the process steps in accordance with the preferred embodiment of the present invention.

DESCRIPTION OF THE PREFERRED EMBODIMENTS

The sequence of steps involved in the process comprising the present invention is schematically illustrated in the flow diagram comprising the drawing. As shown, a cellulosic feed material or mixture of various cellulosic feed materials is introduced into a pretreatment stage in which the feed material is subjected to suitable shredding, pulverizing and screening to provide a feed stock of the desired particle size, whereafter the comminuted feed material is introduced into a high temperature and high pressure reactor in which it is subjected to heat under pressure to extract the moisture content and volatile organic constituents and thermal decomposition products therein to a gaseous phase and to further effect a controlled thermal restructuring of the chemical structure of the carbonaceous feed. The gaseous by-products are withdrawn from the reactor and are introduced into a condenser in which the condensible phase is recovered as condensate, while the substantially noncondensible phase is recovered as a by-product fuel gas which can advantageously be recycled for use in the process and the generation of supplemental power. The reaction product passes from the reaction zone of the reactor into a cooling zone in which it is cooled to a lower temperature at which it can be exposed to the atmosphere without incurring combustion or other adverse effects. From the cooling zone, the solid reaction product or coke product is transferred to storage. In accordance with a preferred embodiment of the present invention, the coke product is transferred from storage to a grinding or comminution stage in which the coke product is further pulverized to a desired size, rendering it suitable for use as a particulated solid fuel consistent with the particular type of furnace and burner design to be employed. It is also contemplated that a portion of the comminuted coke product can be transferred from the grinder to a blender in which it is admixed with a supply of fuel oil, forming a liquid slurry containing a controlled proportion of the particulated wood coke suspended therein. The resultant fuel oil and coke slurry product is transferred from the blender to product storage.

In accordance with the flow diagram, the feed material may comprise any one of a variety or mixture of cellulosic materials, including waste cellulosic materials derived from lumbering operations and agricultural waste. For example, naturally-occurring cellulosic materials, such as peat, as well as waste cellulosic materials, such as sawdust, bark, wood scrap, branches and chips derived from lumbering and sawmill operations, as well as various agricultural waste materials, such as cotton plant stalks, nutshells, corn husks and the like, can be satisfactorily employed.

The feed material, prior to introduction into the autoclave, is optionally subjected to a pretreatment stage which may include a step of subjecting the material to a preliminary treatment to extract excessive water to reduce the residual moisture content therein to a level facilitating handling as well as to reduct the magnitude of moisture to be removed in the subsequent reaction step. Since substantially all of the moisture in the feed material is removed during the autoclaving operation, such a pretreatment step is ordinarily not necessary for most agricultural and lumbering waste materials. The pretreatment step may further include subjecting the feed material to a suitable shredding or comminuting operation, whereby the particle size thereof, depending on the nature of the feed material, is reduced to a size which facilitates handling and processing. The shredding or comminuting step may further include suitable classification or screening steps to separate the oversized particles for recycling through the shredding device.

The feed material, with or without the optional pretreatment step, is thereafter introduced into the inlet end of a reactor in which it is subjected to a temperature of at least about 750° F. and a pressure of at least about 1,000 psi for a controlled period of time to effect a controlled thermal restructuring of the chemical structure thereof, and to effect a conversion of the moisture and a portion of the volatile organic constituents therein, as well as the thermal decomposition products thereof into a gaseous phase which is withdrawn from the reactor and advantageously passed through a condenser for separation and recovery of the condensible phase containing valuable chemical by-product constituents. The substantially noncondensible gaseous phase withdrawn from the condenser can be advantageously employed as a gaseous fuel for heating the reactor and for the generation of auxiliary power for operating the process with the surplus thereof available for commercial sale.

While temperatures of at least about 750° F. are desirable during the autoclaving reaction, temperatures of about 1000° F. are preferred due to the increased rate of volatilization and thermal restructuring of the feed material to produce a higher fixed carbon value, thereby providing for reduced residence times in the autoclave and improved efficiency of operation. The temperature of the autoclaving reaction may range up to as high as about 1250° F., and temperatures above this level are usually undesirable because of too high a ratio of noncondensible gases to solid upgraded coke product. Particularly satisfactory results have been obtained employing temperatures ranging from about 1000° F. to about 1200° F. at pressures ranging from about 1,000 psi to about 3,000 psi. The maximum pressure usable may be as high as about 3,300 psi. Pressures generally above about 3,300 psi are undesirable due to the increased fabrication costs of pressure vessels capable of withstanding pressures of this magnitude and the absence of any appreciable benefits at such elevated pressures beyond those obtained at lower pressure levels of about 3,000 psi.

The residence time of the feed material in the autoclave will vary depending upon the specific temperature-pressure-time relationship which is controlled within the parameters as hereinafter set forth to effect a substantially complete vaporization of the moisture content and volatilization of some of the volatile organic constituents and a controlled thermal restructuring of the cellulosic feed material.

The thermal restructuring is not completely understood but is believed to consist of two or more simultaneous chemical reactions occurring between the pyrolysis products and the gases present within the cellular structure of the cellulosic feed material. The net effect of these restructuring reactions are changes in the chemical characteristics resulting in an increase in the carbon-hydrogen ratio and a decrease in the sulfur and oxygen content as measured by the ultimate analysis of the coke product. During the autoclaving operation, a controlled degree of thermal restructuring and/or decomposition of the chemical structure also occurs, accompanied by the generation of additional gaseous components which also enter the gaseous phase.

The required residence time in the reactor decreases as the temperature and pressure in the autoclave increases; while conversely, increased residence times are required when temperatures and pressures of lower magnitude are employed. Usually, residence times ranging from about 15 minutes up to about one hour at temperatures ranging from about 900° F. to about 1200° F. under pressures of from about 1,000 psi to about 3,000 psi are satisfactory. Advantageous results are also obtained with certain materials employing temperatures and pressures in the upper range of permissible levels utilizing residence times of as little as about 5 minutes, while residence times in excess of an hour can also be employed. Generally, the use of residence times in excess of about one hour do not provide appreciable benefits over those obtained employing residence times of from about 15 minutes to about 1 hour, and the resultant reduced throughput and efficiency of the process associated with such excessive residence times is undesirable from an economic standpoint.

The pressurization of the interior of the autoclave can be conveniently accomplished by controlling the quantity of cellulosic feed material charged relative to the interior volume of the autoclave in consideration of the moisture content of the charge, such that upon heating thereof to the elevated temperature, the formation of the gaseous phase comprised of superheated steam and volatile organic matter effects a pressurization of the autoclave within the desired pressure range. Supplemental pressurization of the autoclave can be achieved, if desired, by introducing pressurized nonoxidizing or reducing gases into the autoclave as well as pressurized steam.

At the conclusion of the autoclaving step, in accordance with one embodiment of the present invention, the autoclave is permitted to cool, either by air cooling or by the use of a cooling fluid, such as cooling water, for example, to a temperature below that at which the autoclave upgraded solid coke product can be exposed to air without adverse effects. Ordinarily, the cooling of the autoclave to a temperature below about 300° F. is adequate. A cooling of the autoclave to temperatures approaching 212° F. or below in the presence of the gaseous phase is generally undesirable because the condensation of the gaseous water phase which wets the coke product increasing its moisture content and correspondingly lowering its heating value. Preferably, the cooling operation is performed after the gaseous phase has been withdrawn to prevent the volatilized organic constituents, including relatively heavy hydrocarbon fractions and tars, from condensing and depositing on the surfaces and within the pores of the coke structure.

The upgraded coke product is generally of a dull black appearance having a porous structure and has a residual moisture content ranging from about 1% to about 5% by weight.

In accordance with the preferred embodiment of the present process, at the completion of the autoclaving operation, the remaining high pressure within the autoclave is released at the autoclaving operating temperature and the hydrocarbon constituents recovered by condensation and the organic noncondensible gaseous constituents recovered as a by-product fuel gas. In this situation, only a small degree of deposition of the volatilized organic constituents is effected on the coke product. The coke product thus produced is nevertheless characterized as having a thermally transformed structure which is of improved heating value.

It is also contemplated that a two-stage autoclaving and coating operation can be performed wherein the gaseous phase released from the autoclave while still at temperature is transferred to a second autoclave chamber in which the feed material to be processed is used as a cooling medium for condensing the tars and oils in the gaseous phase.

The cooled solid coke product is transferred from the cooling zone in accordance with the flow diagram to a coke product storage from which it can be packaged and shipped in containers or bulk form, or alternatively, can be further processed by subjecting it to a suitable comminution or grinding operation to break up any agglomerates formed during the autoclaving operation, as well as to further comminute the product to the desired average particle size range. The magnitude of comminution of the coke product will vary depending on its intended end use and the particular burner design to be employed for effecting combustion thereof as a particulated solid fuel. For example, if the coke product is to be employed in burner designs of the type utilized for the combustion of powdered coal and like fuels, particle sizes of less than about 48 mesh and preferably less than about 200 U.S. Sieve Size, are useable. Alternatively, if the coke product is to be employed in automatic furnace stoking equipment, larger particle sizes can be satisfactorily employed.

Regardless of particle size, the coke product comprises a valuable solid heating fuel and can be directly employed in that form or in admixture with other conventional fuels. The coke product is characterized as having a very low sulfur content, usually less than about 1% by weight, and more usually, from about 0.2% to as low as about 0.06% by weight sulfur. In addition, the coke product is further characterized as having a very low ash content, usually less than about 5% to as little as about 1% or less. Certain agricultural waste feed materials, such as cotton stalks, for example, produce a coke product having up to 20% ash and less than 1% sulfur. Typically, the coke product has a heating value within the range of about 11,000 to about 15,000 btu per pound.

Because of the extremely low sulfur and ash content of the coke product, it can advantageously be employed in admixture with other high sulfur fuels to produce a resultant fuel blend having a substantially lower average sulfur content and in conformance with permissible levels prescribed by EPA and other state and local regulations. While the comminuted coke product can advantageously be blended with particulated solid fuels, such as various bituminous and anthracite coals, particularly advantageous results are obtained when blended with fuel oils to produce a liquid slurry containing as little as about 1% up to about 50% by weight coke. The maximum amount of coke incorporated with the liquid fuel oil is dictated in consideration of the increase in viscosity of the slurry as the concentration of the particulated coke is increased. Generally, the upper limit of coke concentration is that level at which a slurry of the necessary viscosity to enable pumping of the slurry is attained and at which viscosity adequate fragmentation of the slurry is effected through the various types of commercial burner nozzles in existence. While slurry concentrations containing as little as about 1% by weight of the coke are contemplated, concentrations of such low level do not appreciably enhance the benefits attainable by the incorporation of the low sulfur and ash coke products and ordinarily, concentrations of at least about 25% up to about 50% by weight are preferred. At concentration levels of about 50% by weight, the average sulfur content of the slurry blend is approximately one-half of that of the fuel oil employed, thereby enabling the use of a variety of high sulfur fuel oils for producing acceptable fuel oil slurry blends which conform to EPA, state and local sulfur regulations.

It has been discovered that the admixture of the comminuted coke at particle sizes of less than about 150 mesh and preferably of a particle size in which 80% is less than about 200 mesh results in a relatively stable slurry at concentrations as high as 50% coke and 50% fuel oil without the need of employing any appreciable amounts of supplemental suspension agents to provide a stable slurry blend. Ordinarily, no supplementary suspension agents are required employing the present coke product, whereas, in the case of conventional bituminous and anthracite coal-oil slurry blends, such agents are necessary. Accordingly, substantial simplification in the formation of the slurry and a reduction in the cost of the final blend is provided by the present invention.

In order to further illustrate the process of the present invention, the following specific examples are provided. It will be understood that the examples are provided for illustrative purposes and are not intended to be limiting of the scope of the invention as herein described and as set forth in the subjoined claims.

EXAMPLE 1

A cellulosic feed material comprising 59.5 grams of a mixture of dry oak and fir wood are placed in a test reactor together with 23.4 grams of water. The wood charge is in the shape of ¼ inch square and ½ inch square strips of a nominal length of 8 inches.

The test reactor system consists of a cylindrical chamber comprised of stainless steel having an internal diameter of 1⅜ inches and a length of 12 inches, providing a total volume of 18 cubic inches. The reactor is provided with a conduit connected to a water-cooled condenser and a water displacement gas collector. A 5,000 psi pressure gauge is connected to the reactor for continuous pressure monitoring, and a type K thermocouple is inserted into a well in the reactor for continuous temperature monitoring. The system includes a conical point high pressure valve in the conduit between the reactor and gas condenser in order to bleed the gaseous phase from the reactor to maintain the desired pressure within the reactor chamber.

After the reactor is loaded and closed, it is placed in a horizontal position in a hot muffle furnace. After a period of 5 minutes, the reactor pressure is 1,500 psig and the internal temperature as indicated by the thermocouple is 563° F. At this point, the outlet valve is opened slightly and sufficient gas is vented through the condenser system to maintain the pressure within the reactor substantially constant at 1,500 psig. During the next 5 minute period, or after a total of ten minutes following placement of the reactor in the muffle furnace, the temperature within the reactor, as indicated by the thermocouple, is 1030° F. The reactor thereafter is removed from the furnace and allowed to cool to approximately 200° F.

A solid coke product comprising 18.9 grams is recovered from the reactor and 20 cubic centimeters of liquid is recovered from the condenser system. The gas produced is in excess of the capacity of the gas collection bottle, which has a volume of 7,800 cubic centimeters.

A visual inspection of the solid coke product reveals it as being black in color and having a honeycomb structure that predominantly corresponds to the original structure of the cellulosic wood feed and having the appearance of a coked liquid at several locations. The initial individual sticks of oak and fir are deformed during the reaction process, whereby the solid coke product recovered is in the form of a single cylinder of a diameter smaller than that of the reactor chamber.

The gaseous phase recovered burns with a pale blue flame typical of mixtures of hydrogen, carbon monoxide and methanol. An analysis of the solid product is as follows:

| | |
|---|---|
| Moisture (%/wt) | 3.93 |
| Volatile (%/wt) | 8.47<br>8.82 |
| Ash (%/wt) | 1.09<br>1.13 |
| Fixed Carbon (%/wt) | 86.5<br>90.1 |
| Heating value, BTU/lb | 14,311<br>14,898 |

-continued

| Chemical Analysis | |
|---|---|
| C (%/wt) | 88.8<br>92.4 |
| H (%/wt) | 2.06<br>2.14 |
| S (%/wt) | 0.12<br>0.12 |
| N (%/wt) | 0.18<br>0.19 |
| O (%/wt) | 3.82<br>4.02 |

EXAMPLE 2

A 100-gram charge of a Canadian spagnum peat is placed in the test reactor system as previously described in connection with FIG. 1 equipped with steam-cooled and water-cooled condensers. An analysis of the charge material indicates a moisture content of about 75% by weight.

After loading the reactor, it is placed in a horizontal position in a hot muffle furnace in the manner as previously described in connection with Example 1, and after a period of 11 minutes, the reactor pressure is 1,650 psig and the internal temperature, as indicated by the thermocouple, indicates 508° F. At this point, the outlet gas valve is opened slightly and sufficient gas is vented from the reactor through the condenser system to maintain the pressure substantially constant at 1,500 psig.

After an additional 23 minute heating period or a total of 34 minutes after the reactor is placed in the muffle furnace, the reactor temperature is 1011° F. The reactor is thereafter removed from the furnace and the high pressure valve is opened to release all of the gaseous phase until the reactor chamber attains atmospheric pressure. The valve is then closed and the reactor allowed to cool to ambient temperature.

At the completion of the test, the steam heated condenser contains 74 grams of liquid, while the water-cooled condenser contains 5 grams liquid and 4.25 liters of noncondensible gas is collected in the gas collector. The solid coke reaction product comprises 6.99 grams, which on visual inspection reveals it to comprise a fragile, black solid product which upon oxidation produces 0.256 grams of ash.

An analysis of the collected gas which upon ignition is observed to burn with a blue flame is as follows:

| Collected Gas Analysis | |
|---|---|
| Constituent | Mol Percent |
| Hydrogen | 4.96 |
| Water | 0.24 |
| Oxygen | 1.23 |
| Hydrogen Sulfide | 0.00 |
| Argon | 0.11 |
| Carbon Dioxide | 52.51 |
| Methane | 19.24 |
| Ethane | 2.13 |
| Ethylene | 0.12 |
| Propane | 0.29 |
| Propylene | 0.14 |
| Isobutane | 0.02 |
| n-Butane | 0.05 |
| Butene | 0.03 |
| Isopentane | 0.01 |
| n-Pentane | 0.01 |
| Pentene | 0.02 |
| Hexane | 0.00 |
| Heptane | 0.05 |
| Benzene | 0.38 |
| Octane | 0.00 |
| Toluene | 0.09 |
| Nonane | 0.00 |
| Xylene | 0.00 |
| Nitrogen | 14.44 |

-continued

| Collected Gas Analysis | |
|---|---|
| Constituent | Mol Percent |
| Carbon Monoxide | 3.93 |
| BTU/Scf | 299.1 |

EXAMPLE 3

The test as described in Example 2 is repeated employing 173 grams of the same peat charge material utilizing the same equipment. The reactor pressure eight minutes after the reactor is placed in the muffle furnace is 1,500 psig, and the temperature within the reactor chamber is 450° F. After an additional residence time of 21 minutes at temperature, or a total of 29 minutes after the initiation of the heating cycle, the temperature within the reactor is 1005° F. and the pressure is maintained substantially constant at 1,500 psig by bleeding the gaseous phase to the condenser system.

A total of 58 cubic centimeters of a dark brown liquid is recovered in the steam heated condenser, while 63 cubic centimeters of a yellow-colored water is recovered in the water-cooled condenser. A total of 11.2 liters of gas are collected in the gas collection system. A solid coke product comprising 19.2 grams similar to that obtained in Example 2 is recovered. The gas upon ignition is observed to burn with a blue flame identical to that of Example 2.

The solid coke product recovered contains 0.41 percent by weight moisture and is of a proximate and ultimate composition on a moisture-free basis as set forth in the following table:

| Analysis, Peat Feed Material and Coke Product | | |
|---|---|---|
| Proximate Analysis, % by weight | Peat Feed Material | Solid Coke Product |
| Volatile | 77.5 | 6.34 |
| Ash | 1.22 | 4.40 |
| Fixed C | 21.3 | 89.3 |
| Higher Heating Value BTU/lb | 8702 | 14454 |
| Ultimate Analysis, % by weight | | |
| C | 51.8 | 90.7 |
| H | 3.14 | 3.35 |
| S | 0.15 | 0.14 |
| N | 0.61 | 0.83 |
| O | 43.0 | 0.61 |

The solid coke product, on a moisture-free basis, clearly evidences an improvement in its heating value over the feed material in a magnitude of 66% and comprises a high quality, low ash, low sulfur solid fuel. The product, upon subsequent grinding to a particle size of about 200 mesh, is ideally adapted for admixture with residual fuel oils of high sulfur content to produce a moderately low sulfur slurry-type burner fuel.

A fuel oil slurry is prepared employing the finely ground coke product derived from the peat by admixing equal amounts of weight of the coke product with a residual fuel oil containing 1% sulfur. A suspension of the coke particles in the fuel oil is achieved by addition of the particulate coke product to the fuel oil while agitated by a high-shear mixer. The coke product is added to provide a concentration of about 40% by weight of the total slurry.

The resultant fuel oil slurry has an average net sulfur content of 0.66%, rendering it suitable for use as a fuel in public utilities for the generation of electric power and in conformance with the requirements of EPA regulations on maximum sulfur content. The resultant slurry is further observed to remain substantially stable with the solid coke particles remaining substantially uniformly suspended without the use of ancillary suspension and/or dispersing agents.

EXAMPLE 4

A feed material typical of a forest waste product comprising pine and fir bark in an amount of 51.76 grams is charged to a reactor system as previously described in Example 2. After seven minutes, the pressure reaches 1,500 pounds and the gas is vented to maintain constant pressure. The temperature within the reactor was 541° F. After an additional residence time of 13 minutes, the temperature in the reactor is 990° F. and the pressure is maintained substantially constant at about 1,500psi by bleeding the gaseous phase to the condenser system. 17.9 grams of solid coke product is recovered. 15.8 grams of liquid is recovered.

The steam condenser product consists of 5.3 milliliters of yellow liquid, with 0.6 milliliter of tarry material floating on the top. The water condenser product consists of 10.5 milliliters of clear liquid with a trace of oil. The liquid from both condensers is combined and 14.6 milliliters of water is separated. 0.254 grams of hexane soluble tars are recovered. 0.28 grams of benzene soluble tar is recovered. Approximately 9,000 cubic centimeters of noncondensible gas is recovered. The composition and fuel value of the solid coke product and the composition of the noncondensible gaseous phase are set forth in the following tables:

| Solid Product Composition and Fuel Value | |
|---|---|
| Solid produced (Kg/Kg feed) | 0.346 |
| Moisture percent | 0.27% |
| Proximate analysis (moisture-free) | |
| Volatile,% | 11.04% |
| Fixed carbon,% | 84.09% |
| Ash,% | 4.87% |
| Ultimate analysis (moisture-free) | |
| C,% | 88.58% |
| H,% | 2.71% |
| S,% | 0.06% |
| N,% | 1.36% |
| O,% | 2.42% |
| Heating value | |
| BTU/lb | 14,279 |
| Kcal/gm | 7.932 |

| Product Gas Composition | |
|---|---|
| Volume of gas produced | |
| (liters/Kg feed) | 180.4 |
| (SCF/ton) | (5784) |
| Average mol wt | 31.9 |
| Heating value | |
| ($Kcal/M^3$) | 4483 |
| (BTU/SCF) | (503.7) |
| Composition mol percent (moisture-free) | |
| $H_2$ | 5.87% |
| $CH_4$ | 29.32% |
| CO | 7.55% |
| $C_{2's}$ | 4.65% |
| $CO_2$ | 50.19% |
| $C_{3's}$ | 0.99% |
| $C_{4's}$ | 0.47% |
| $C_{5's}$ | 0.26% |
| $C_{6's}$ | 0.40% |

EXAMPLE 5

A test employing the reactor equipment as previously described in connection with Example 2 is repeated employing 51.8 grams of a cellulosic feed material comprising an agricultural waste of cotton stalks and hulls. The reactor pressure attained 1,500 psi in 6 minutes after placement in the muffle furnace at a reactor internal temperature of 422° F. At this point, the valve is opened and the gaseous phase bled to maintain a reactor pressure substantially constant at about 1,500 psi. After an additional 17 minute heating in the muffle furnace, the temperature is 1006° F., for a total reaction period of 23 minutes, and gas is continuously bled to maintain the pressure at 1,500 psi. At the end of this time, the reactor is taken from the furnace and the pressure released to atmospheric pressure. Total gas recovered is 11,240 cubic centimeters. Total solid product is 16.1 grams and total tars recovered is 0.6 grams.

The composition and fuel value of the solid coke product and the composition of the noncondensible gaseous phase are set forth in the following tables:

| Solid Product Composition and Fuel Value | |
|---|---|
| Solid produced (Kg/Kg feed) | 0.310 |
| Moisture percent | 1.58% |
| Proximate analysis (moisture-free) | |
| Volatile,% | 17.45% |
| Fixed carbon,% | 62.00% |
| Ash,% | 20.55% |
| Ultimate analysis (moisture-free) | |
| C,% | 72.28% |
| H,% | 2.62% |
| S,% | 0.69% |
| N,% | 1.20% |
| O,% | 2.66% |
| Heating value | |
| BTU/lb | 11,510 |
| Kcal/gm | 6.394 |

| Product Gas Composition | |
|---|---|
| Volume of gas produced | |
| (liters/Kg feed) | 217.0 |
| (SCF/ton) | (6966) |
| Average mol wt | 29.2 |
| Heating value | |
| (Kcal/M$^3$) 4759 | |
| (BTU/SCF) | (534.8) |
| Composition mol percent (moisture-free) | |
| $H_2$ | 10.30% |
| $CH_4$ | 34.44% |
| CO | 3.66% |
| $C_{2's}$ | 4.01% |
| $CO_2$ | 44.97% |
| $C_{3's}$ | 1.40% |
| $C_{4's}$ | 0.87% |
| $C_{5's}$ | 0.18% |
| $C_{6's}$ | 0.17% |

EXAMPLE 6

A charge comprising 60 grams of wood shavings and 15 cc water is placed in a test reactor. The test reactor system consists of a cylindrical chamber comprised of stainless steel having a diameter of 1.25 inches and a length of 13.5 inches, providing a volume of 16.3 cubic inch. The reactor is provided with a conduit connected to a water-cooled condenser and a water displacement gas collector. A 5,000 psi pressure gauge is connected to the reactor for continuous pressure monitoring, and a Type K thermocouple is inserted into the well in the reactor system for continuous temperature monitoring. The system includes a conical point high pressure valve in the conduit between the reactor and gas condenser in order to bleed the gaseous phase from the reactor to maintain the desired pressure within the reaction chamber.

After the reactor is loaded and closed, it is placed in a horizontal position in a hot muffle furnace. After a period of 9 minutes, the reactor pressure is 1,750 psig and the temperature, as indicated by the thermocouple, is 480° F. At this point, the reactor valve is opened slightly and sufficient gas is released through the condenser system to maintain the pressure within the reactor substantially constant at 1,500 psig. During the next 21 minute period, or after a total of 30 minutes after the reactor is placed in the muffle furnace, the reactor temperature is 1004° F., whereafter the reactor is removed from the furnace, the pressure is reduced to 15 psig, and the reactor is permitted to air cool.

A coke product comprising 14.6 grams is recovered, along with 11,200 cubic centimeters of a noncondensible combustible gas representing a total solids recovery of 24%. The solid coke product is characterized as being coke-like in appearance, having a brittle porous structure. The noncondensible fuel gas recovered burns with a yellow-tipped flame.

The solid product is ground in a laboratory-sized ball mill for 10 minutes then screened through a 200 mesh sieve. The +200 mesh fraction is ground for 10 minutes and rescreened. The +200 mesh fraction is ground for 5 additional minutes, after which 12.75 grams passed 100 mesh and 8.69 grams passed 200 mesh. 12.75 grams of ground solids is added to 8.52 grams of Bunker C fuel oil to form a stiff paste containing 60% solids. Additional oil is added to the stiff paste until the voids appeared to be filled. At this time, the composition is 56% solids. Additional oil is added until the mixture is observed to flow at room temperature. This composition contained 52% solids.

A second batch of oil-solid slurry is prepared from a similar coke solid product prepared from wood which had been ground in a ball mill and screened through a 200 mesh sieve. When this solid coke product is mixed with an equal weight of Bunker C fuel oil, the resulting slurry is found to be a nonnewtonian fluid having a viscosity of 20,500 cps units at 200° F. when measured on a Brookfield viscosimeter at 6 RPM and 12,100 cps units when measured at 60 RPM.

In the specific examples hereinbefore provided, the autoclave comprised a laboratory scale model providing for a batch-type autoclave of the feed material. It will be appreciated that autoclaves of any of the types known in the art capable of withstanding the elevated temperatures and pressures required in the practice of the process of the present invention can also be satisfactorily employed. It will also be understood while the description as herein provided has been primarily directed to batch-type autoclaves, continuous autoclaves can also be employed for the practice of the process in which the feed material is continuously introduced into the inlet end of the reactor through a suitable pressure lock-hopper or valve arrangement, and the coke product is continuously extracted from the cooling zone of the reactor through a similar pressure lock-hopper or valve arrangement.

While it will be apparent that the invention herein described is well calculated to achieve the benefits and advantages set forth, it will be appreciated that the invention is susceptible to modification, variation and change without departing from the spirit thereof.

What is claimed is:

1. A process for converting cellulosic feed materials into a useful solid fuel which comprises the steps of charging the cellulosic feed material into an autoclave, heating said feed material to an elevated temperature of at least about 750° F. up to about 1250° F. and pressure of at least about 1000 psi for a period of time to convert the moisture and at least a portion of the volatile organic constituents therein into a gaseous phase and to effect a partial thermal restructuring of the chemical structure thereof and a change in its chemical composition to produce a solid reaction product, and thereafter cooling said reaction product and recovering the upgraded solid coke product.

2. The process as described in claim 1, in which the step of heating said feed material in said autoclave is conducted at a temperature of at least about 900° F. up to about 1250° F.

3. The process as defined in claim 1, in which the step of heating said feed material in said autoclave is conducted at a temperature of from about 1000° F. to about 1200° F.

4. The process as defined in claim 1, in which the step of heating said feed material in said autoclave is carried out at a pressure of at least about 1,000 psi to about 3,300 psi.

5. The process as defined in claim 1, in which the step of heating said feed material in said autoclave to the elevated temperature is conducted at a pressure of about 1,500 psi to about 3,000 psi.

6. The process as defined in claim 1, including the further step of recovering the gaseous phase from said autoclave, extracting at least a portion of the condensible constituents in said gaseous phase and recovering the condensible portion and the noncondensible portion.

7. The process as defined in claim 1, including the further step of comminuting the recovered solid coke product to a desired particle size.

8. The process as defined in claim 1, including the further step of comminuting the solid coke product to a particle size of less than about 48 mesh, admixing the comminuted said coke product with a fuel oil in an amount of from about 1% up to about 50% by weight coke product based on the total weight of the mixture producing a liquid fuel oil slurry.

9. The process as defined in claim 8, in which the step of comminuting the solid coke product is performed to produce particles predominantly of a size less than 200 mesh.

10. The process as defined in claim 1, in which said feed material comprises cellulosic materials selected from the group consisting of peat, agricultural waste materials, forest waste materials and mixtures thereof.

11. A liquid fuel comprising a mixture of a residual fuel oil and a wood coke particulate solid fuel produced in accordance with the process as defined in claim 1, said wood coke solid fuel present in an amount of from about 1% up to about 50% by weight of the fuel slurry, said wood coke being present in the form of suspended particles substantially uniformly distributed and having an average particle size of less than about 48 mesh.

12. The liquid fuel defined in claim 11, in which said suspended particles are predominantly of a size less than about 200 mesh.

* * * * *